US012759824B2

(12) United States Patent
Kobayashi

(10) Patent No.: US 12,759,824 B2
(45) Date of Patent: Oct. 13, 2026

(54) SHEET CONVEYANCE DEVICE AND IMAGE FORMING APPARATUS

(71) Applicant: CANON KABUSHIKI KAISHA, Tokyo (JP)

(72) Inventor: Yuki Kobayashi, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 19/265,847

(22) Filed: Jul. 10, 2025

(65) Prior Publication Data

US 2026/0021987 A1 Jan. 22, 2026

(30) Foreign Application Priority Data

Jul. 18, 2024 (JP) ..... 2024-115134
May 7, 2025 (JP) ..... 2025-077310

(51) Int. Cl.

| | |
|---|---|
| ***B65H 5/06*** | (2006.01) |
| ***B65H 5/26*** | (2006.01) |
| ***B65H 7/06*** | (2006.01) |
| ***B65H 7/14*** | (2006.01) |
| ***B65H 7/20*** | (2006.01) |
| ***B65H 9/00*** | (2006.01) |

(52) U.S. Cl.

CPC ..... *B65H 5/062* (2013.01); *B65H 5/26* (2013.01); *B65H 7/06* (2013.01); *B65H 7/14* (2013.01); *B65H 7/20* (2013.01); *B65H 9/006* (2013.01); *B65H 2407/21* (2013.01); *B65H 2513/10* (2013.01); *B65H 2513/50* (2013.01); *B65H 2553/80* (2013.01); *B65H 2601/272* (2013.01)

(58) Field of Classification Search

CPC . B65H 5/062; B65H 5/26; B65H 7/06; B65H 7/08; B65H 7/14; B65H 7/20; B65H 9/006; B65H 2407/21; B65H 2513/10; B65H 2513/50; B65H 2513/52; B65H 2553/80; B65H 2601/272

See application file for complete search history.

(56) References Cited

U.S. PATENT DOCUMENTS 5,342,037 A * 8/1994 Martin ..... B65H 7/02 271/111
2008/0258380 A1* 10/2008 Okumura ..... B65H 7/20 271/258.01

(Continued)

FOREIGN PATENT DOCUMENTS

JP H06127753 A 5/1994

*Primary Examiner* — Prasad V Gokhale

(74) *Attorney, Agent, or Firm* — Canon.U.S.A., Inc. IP Division

(57) ABSTRACT

A sheet conveyance device includes a feeding unit, a first conveyance path, a registration roller pair, a first conveyance roller pair, a first sensor, a second sensor, and a control unit, wherein the control unit controls the first conveyance roller pair to correct skew of the sheet, and when a sheet is conveyed from the first conveyance roller pair toward the registration roller pair, in a case where a time is a first time, the control unit controls the conveyance of the sheet so that the sheet is conveyed toward the second sensor at a first speed, and in a case where a time is a second time longer than the first time, the control unit controls the conveyance of the sheet so that the sheet is conveyed toward the second sensor at a second speed larger than the first speed.

11 Claims, 8 Drawing Sheets

(56) References Cited

U.S. PATENT DOCUMENTS

| | | | | |
|---|---|---|---|---|
| 2009/0236799 | A1* | 9/2009 | Katou | B65H 5/062<br>271/264 |
| 2015/0021846 | A1* | 1/2015 | Lee | B65H 3/06<br>271/229 |

* cited by examiner

SHEET CONVEYANCE DEVICE AND IMAGE FORMING APPARATUS

BACKGROUND

Field of the Technology

The present disclosure relates to a sheet conveyance device that conveys a sheet, and an image forming apparatus including the sheet conveyance device.

Description of the Related Art

An image forming apparatus has been conventionally provided with a skew correction mechanism that corrects skew of a conveyed sheet, in order to align positions of a sheet and an image to be formed on the sheet. The skew correction mechanism is a mechanism that corrects orientation of a conveyed sheet to be straight in a case where the conveyed sheet is skewed. There has been known a skew correction mechanism including a registration roller pair, and a pre-registration roller pair arranged upstream of the registration roller pair in a sheet conveyance direction (refer to Japanese Patent Application Laid-Open No. H06-127753).

The skew correction mechanism corrects skew of a leading end portion of a sheet conveyed by the pre-registration roller pair, by detecting the leading end of the conveyed sheet, using a registration sensor, and then bringing the leading end into contact with the stopped registration roller pair, and furthermore forming a loop with a predetermined loop amount. By driving of the registration roller pair synchronized with an image signal, the registration roller pair and the pre-registration roller pair start conveyance of the skew-corrected sheet at the same speed, and the sheet is conveyed to a secondary transfer portion in an image forming unit.

Nevertheless, in the sheet conveyance device discussed in Japanese Patent Application Laid-Open No. H06-127753, a conveyance speed of a sheet on a conveyance path arranged upstream of the registration roller pair might vary depending on the rigidity of the sheet, the surface texture of the sheet, and a sheet conveyance resistance generated due to a cross-sectional configuration of a conveyance path. Such a variation brings about a problem that a timing at which the sheet leading end reaches the registration roller pair varies, and the correction accuracy of the skew and the leading end position of the sheet deteriorates.

SUMMARY

The present disclosure is directed to providing a sheet conveyance device and an image forming apparatus that highly precisely execute skew correction of sheets.

According to some embodiments of the present disclosure, a sheet conveyance device includes a feeding unit configured to feed a sheet from a sheet storage unit configured to store a sheet, a first conveyance path on which the sheet fed by the feeding unit is conveyed in a sheet conveyance direction, a registration roller pair that is arranged on the first conveyance path and is configured to come into contact with a leading end of the sheet in the sheet conveyance direction and correct skew of the sheet and then convey the sheet while nipping the sheet therebetween, a first conveyance roller pair that is arranged on the first conveyance path and is configured to convey the sheet to the registration roller pair, a first sensor that is arranged between the first conveyance roller pair and the registration roller pair on the first conveyance path and is configured to detect the leading end of the sheet, a second sensor that is arranged between the registration roller pair and the first sensor and is configured to detect the leading end of the sheet, and a control unit configured to control conveyance of the sheet, wherein, based on a detection result of the second sensor, the control unit controls the first conveyance roller pair to correct skew of the sheet, and wherein, when a sheet is conveyed from the first conveyance roller pair toward the registration roller pair, in a case where a time from a timing at which the feeding unit feeds the sheet until the leading end of the sheet is detected by the first sensor is a first time, the control unit controls the conveyance of the sheet so that the sheet is conveyed toward the second sensor in a state in which a conveyance speed of the first conveyance roller pair is a first speed, and in a case where a time from a timing at which the feeding unit feeds the sheet until the leading end of the sheet is detected by the first sensor is a second time longer than the first time, the control unit controls the conveyance of the sheet so that the sheet is conveyed toward the second sensor in a state in which a conveyance speed of the first conveyance roller pair is a second speed larger than the first speed.

According to another aspect of the present disclosure, an image forming apparatus includes the above-described sheet conveyance device and an image forming unit configured to form an image on a sheet.

Features of the present disclosure will become apparent from the following description of embodiments with reference to the attached drawings. The following description of embodiments is described by way of example.

BRIEF DESCRIPTION OF THE DRAWINGS

FIG. 4A illustrates a state in which the leading end of a sheet is detected by a first sensor, FIG. 4B illustrates a state in which the leading end of a sheet is detected by a second sensor, and FIG. 4C illustrates a state in which a loop of a sheet is formed.

FIG. 5A illustrates a transition of a sheet position, FIG. 5B illustrates a transition of a pre-registration roller speed, and FIG. 5C illustrates a transition of a registration roller speed, in a case where the sheet reaches each point at a standard time.

FIG. 6A illustrates a transition of a sheet position, FIG. 6B illustrates a transition of a pre-registration roller speed, and FIG. 6C illustrates a transition of a registration roller speed, in a case where the sheet reaches each point at a time later than the standard time.

FIG. 7A illustrates a transition of a sheet position, FIG. 7B illustrates a transition of a pre-registration roller speed, and FIG. 7C illustrates a transition of a registration roller speed, in a case where the sheet reaches each point at a time earlier than the standard time.

DESCRIPTION OF THE EMBODIMENTS

Figure 1:
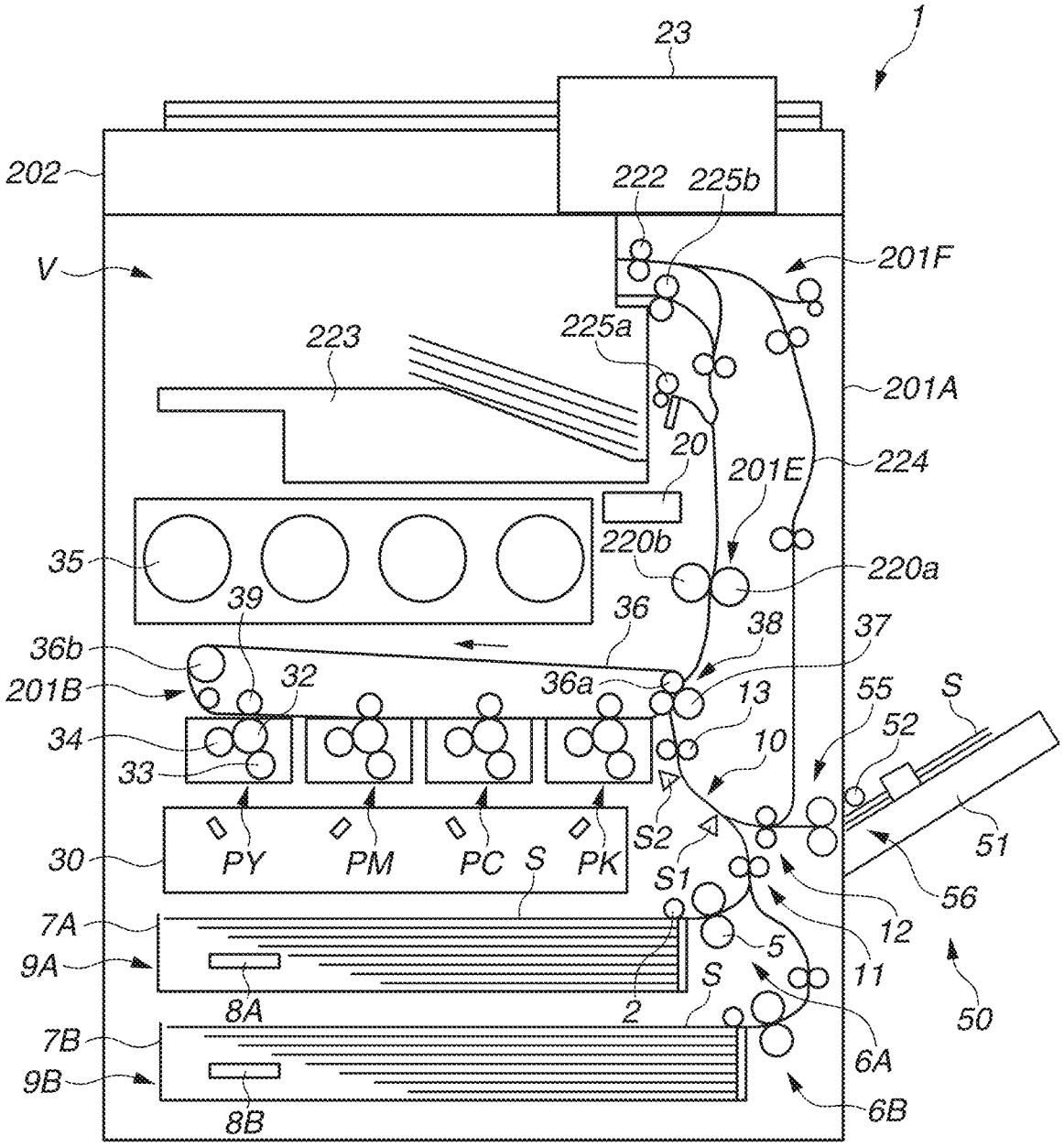
FIG. 1 is a cross-sectional diagram illustrating an image forming apparatus according to an exemplary embodiment.

A first exemplary embodiment will be described with reference to the drawings. A schematic configuration of an image forming apparatus 1 according to the present exemplary embodiment will be described with reference to FIG. 1. FIG. 1 is a cross-sectional diagram illustrating a schematic configuration of the image forming apparatus 1 according to the present exemplary embodiment that is viewed from a front side. The image forming apparatus 1 is a tandem system-intermediate transfer system laser beam printer that uses an electrophotographic process. The image forming apparatus 1 can form a full-color or single-color image corresponding to print image data output from a host apparatus (not illustrated) connected to a control unit 20, on a sheet S serving as a recording medium, and output the sheet S.

[Image Forming Apparatus]

The image forming apparatus 1 includes an apparatus main body 201A, and an image forming unit 201B that forms an image on the sheet S. An approximately-horizontally-installed image reading device 202 is provided above the apparatus main body 201A. A discharge space V for sheet discharge is formed between the image reading device 202 and the apparatus main body 201A. In the present exemplary embodiment, the image forming apparatus 1 is an example of a sheet conveyance device.

[Feeding Unit]

Sheets S are stored in feeding cassettes 7A and 7B of cassette feeding units 9A and 9B for each size, for example, or stacked on and supported by a manual feed tray 51 of a manual feeding unit 50.

The cassette feeding units 9A and 9B respectively include the feeding cassettes 7A and 7B that store the sheets S, and feeding units 6A and 6B that feed the sheets S from the feeding cassettes 7A and 7B. The feeding cassettes 7A and 7B serve as an example of a sheet storage unit in which the sheets S are stored and that is accommodated in the apparatus main body 201A. The feeding units 6A and 6B serve as an example of a first feeding unit that feeds the sheets S stored in the feeding cassettes 7A and 7B, to a first pre-registration roller pair 11.

While the cassette feeding units 9A and 9B store the sheets S with different sizes, the configurations of the feeding units 6A and 6B are similar. Thus, the feeding unit 6A will be described. The feeding unit 6A includes a pick-up roller 2, and a separation roller pair 5 for separating the sheets S fed by the pick-up roller 2. The separation roller pair 5 includes a feed roller 3 (refer to FIG. 3) and a retard roller 4 (refer to FIG. 3). Each sheet S separated by the separation roller pair 5 is conveyed by the first pre-registration roller pair 11 to a registration roller pair 13. That is, the feeding units 6A and 6B feed the sheets S stored in the feeding cassettes 7A and 7B, to the first pre-registration roller pair 11.

In order to record an image within an appropriate range of the sheet S, the control unit 20 may be caused to recognize the size of the stored sheet S. The feeding cassettes 7A and 7B are provided with sheet size detection units 8A and 8B. The sheet size detection units 8A and 8B each include a rotatable size detection lever that is slidably in contact with and is operated simultaneously with a side regulation plate that regulates the position of the sheet S in a width direction, and a plurality of sensors or switches. In an attachment portion to which the feeding cassettes 7A and 7B are attached, the plurality of sensors or switches is provided at positions corresponding to the size detection lever. Thus, if the side regulation plate is moved in accordance with a side end portion of the sheet S, the size detection lever simultaneously rotates. If the feeding cassettes 7A and 7B are attached to the attachment portion in this state, the size detection lever selectively turns on or off detection elements of the sensors or the switches arranged in the attachment portion to which the feeding cassettes 7A and 7B are attached. Signals with different patterns are accordingly transmitted to the control unit 20 from the sensors or the switches. Then, the control unit 20 can recognize the sizes of the sheets S stored in the feeding cassettes 7A and 7B, based on the signals.

The manual feeding unit 50 can be freely opened and closed by rotating with respect to the apparatus main body 201A, can be displaced to a closed position and an open position, and is detachably attached to the apparatus main body 201A. The manual feeding unit 50 includes the manual feed tray 51 being a unit that supports the sheets S, and a feeding unit 56 that feeds the sheets S from the manual feed tray 51. The manual feed tray 51 supports the sheets S stacked on its top surface in an opened state. The feeding unit 56 is an example of a second feeding unit that feeds the sheet S supported on the manual feed tray 51, to a second pre-registration roller pair 12.

The feeding unit 56 includes a pick-up roller 52, and a separation roller pair 55 for separating the sheets S fed from the pick-up roller 52. The separation roller pair 55 includes a feed roller 53 (refer to FIG. 3) and a retard roller 54 (refer to FIG. 3). Each sheet S separated by the separation roller pair 55 is conveyed by the second pre-registration roller pair 12 to a registration roller pair 13. That is, the feeding unit 56 feeds the sheets S supported on the manual feed tray 51, to the second pre-registration roller pair 12.

[Image Forming Unit]

The image forming unit 201B forms an image on the sheet S fed by a cassette feeding unit 230 or the manual feeding unit 50 and conveyed by the registration roller pair 13. The image forming unit 201B includes four process cartridges PY, PM, PC, and PK that respectively form four-color toner images including yellow (Y), magenta (M), cyan (C), and black (K), an exposure unit 30, and an intermediate transfer belt 36. The four process cartridges PY, PM, PC, and PK have the same configuration except that colors of images to be formed are different.

For this reason, the configuration and an image formation process of only the process cartridge PY will be described, and the description of the process cartridges PM, PC, and PK will be omitted. The image forming unit 201B includes a secondary transfer portion 38 and a fixing unit 201E that are arranged on the upper side of the process cartridges PY, PM, PC, and PK. A toner cartridge 35 supplies toner to a development roller 34.

The process cartridge PY includes a photosensitive drum 32 being a drum-shaped electrophotographic photosensitive member, a charging roller 33, and the development roller 34. The photosensitive drum 32 is rotatably supported by the image forming apparatus 1, and rotationally driven by a drive unit (not illustrated). The photosensitive drum 32 is formed by providing a photoconductive layer such as an organic photoconductor (OPC) on an outer circumferential surface of an aluminum cylinder. The charging roller 33 charges the photosensitive drum 32. The charging roller 33 includes a core metal and a conductive elastic member surrounding the core metal, is arranged in contact with the surface of the photosensitive drum 32 to be driven to rotate, and a charging bias is applied to the charging roller 33 by a power source (not illustrated). The development rollers 34 respectively supply toners with different colors (yellow, magenta, cyan, and black) from the process cartridges PY, PM, PC, and PK to the surfaces of the photosensitive drums 32. The development roller 34 forms a toner image on the surface of the photosensitive drum 32 by supplying toner to an electrostatic latent image on the surface of the photosensitive drum 32 and developing the electrostatic latent image.

The exposure unit 30 stores a laser light source that emits laser light to the inside of a casing, and various optical members for performing deflection and scanning by guiding laser light emitted from the laser light source to a corresponding photosensitive drum 32. The exposure unit 30 emits laser light that is based on image information, to the charged surface of the photosensitive drum 32, and forms an electrostatic latent image.

The secondary transfer portion 38 includes the intermediate transfer belt 36 stretched around a drive roller 36*a* and a tension roller 36*b*. On the inside of the intermediate transfer belt 36, a primary transfer roller 39 being in contact with the intermediate transfer belt 36 is provided at a position where the primary transfer roller 39 faces the photosensitive drum 32. The intermediate transfer belt 36 is rotated in a direction of the arrow by the drive roller 36*a* driven by a drive unit (not illustrated). A secondary transfer roller 37 that transfers a color image formed on the intermediate transfer belt 36, to the sheet S is provided at a position of the secondary transfer portion 38 where the secondary transfer roller 37 faces the drive roller 36*a*.

The fixing unit 201E is arranged on the upper side of the secondary transfer roller 37, and a first discharge roller pair 225*a*, a second discharge roller pair 225*b*, and a duplex reversing unit 201F are arranged on the upper side of the fixing unit 201E. The duplex reversing unit 201F is an example of a re-conveyance unit, reverses the side of the sheet S on which an image is formed by the image forming unit 201B, and conveys the sheet S to the second pre-registration roller pair 12. The duplex reversing unit 201F includes a reversing roller pair 222 that can rotate forward and backward, and a re-conveyance path 224 for conveying the sheet S on which an image is formed on its first surface, again to the image forming unit 201B. An operation unit 23 for receiving operations from a user is provided in an upper portion of the image forming apparatus 1.

As the operation unit 23, a touch panel method having both a display function and an input function is employed. The operation unit 23 is connected to the control unit 20, and receives various types of information (size information, grammage information, surface texture information, etc.) regarding sheets to be used by the user for printing, and various operations performed by the user, such as a printing execution instruction or a printing interruption instruction.

[Control System]

Figure 2:
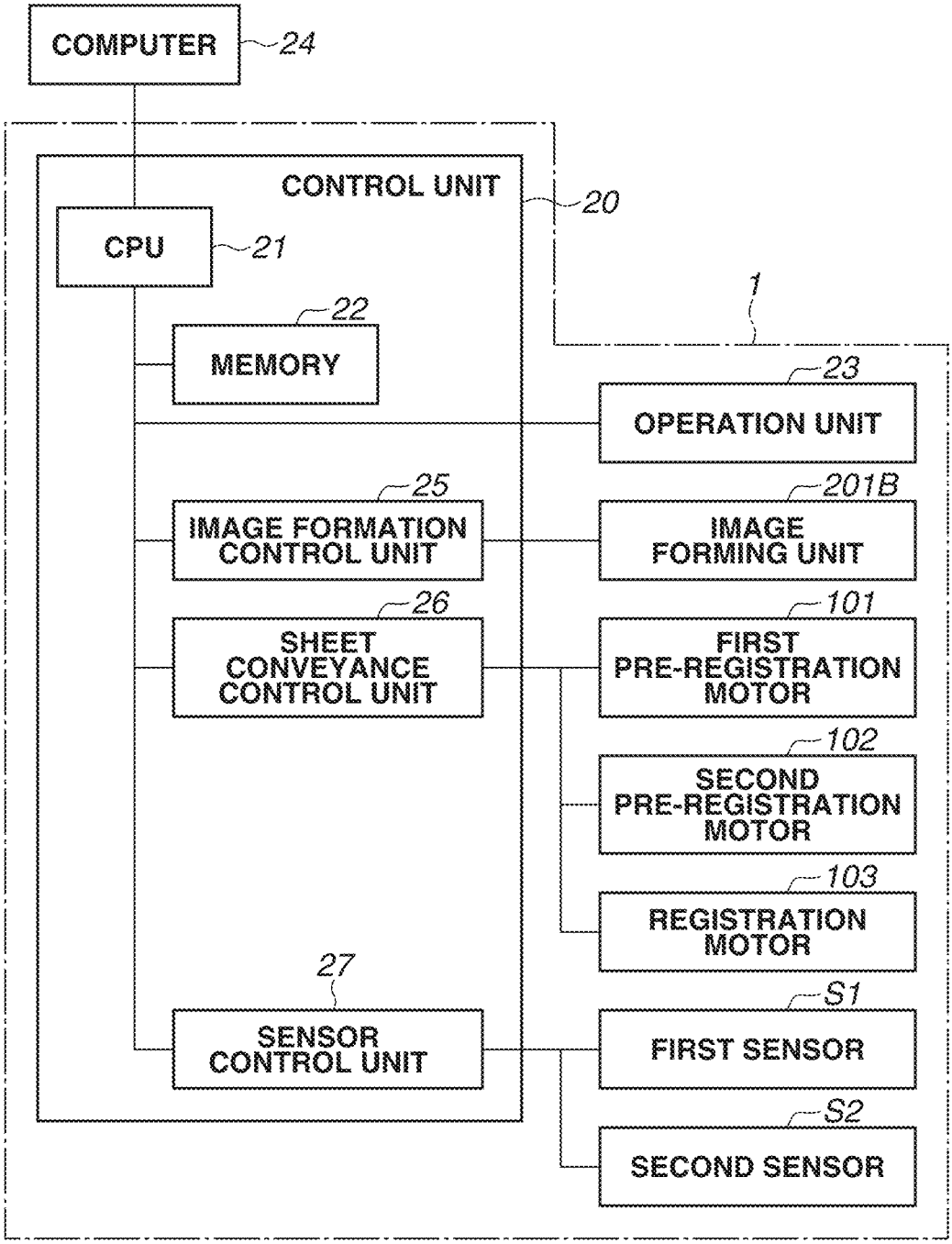
FIG. 2 is a block diagram illustrating a control system of an image forming apparatus according to the exemplary embodiment.

The control unit 20 and a control system of the image forming apparatus 1 will be described with reference to FIG. 2. The control unit 20 includes functional units such as a central processing unit (CPU) 21, a memory 22, an image formation control unit 25, a sheet conveyance control unit 26, and a sensor control unit 27. By executing predetermined control programs, the CPU 21 implements various types of processing to be performed by the image forming apparatus 1. The memory 22 is, for example, a random access memory (RAM) or a read only memory (ROM), and stores various programs and various types of data into a predetermined storage region.

The image formation control unit 25 controls image formation by issuing instructions to the image forming unit 201B including the exposure unit 30. The sheet conveyance control unit 26 controls the conveyance of the sheet S by issuing instructions to a first pre-registration motor 101, a second pre-registration motor 102, and a registration motor 103, and controlling the driving of various conveyance rollers. The sensor control unit 27 controls a detection start or a detection stop of a first sensor S1 and a second sensor S2, and receives detection results of these sensors. For example, the control unit 20 can be configured to be able to receive various types of information regarding sheets to be used for printing, via a computer 24 connected via a network. By controlling the first pre-registration motor 101, the control unit 20 can change the conveyance speed of the sheet S by adjusting the rotational speed of the first pre-registration roller pair 11. By controlling the second pre-registration motor 102, the control unit 20 can change the conveyance speed of the sheet S by adjusting the rotational speed of the second pre-registration roller pair 12.

[Image Formation Operation]

An image formation operation of the image forming apparatus 1 will be described. First of all, when image data of a document to be printed by the image forming apparatus 1 is received, image information of the image data is subjected to image processing, and then converted into an electric signal, and transmitted to the exposure unit 30 of the image forming unit 201B. In the image forming unit 201B, the surfaces of the photosensitive drums 32 that are uniformly charged by the charging rollers 33 to a predetermined polarity and potential are sequentially exposed to laser. Yellow, magenta, cyan, and black electrostatic latent images are accordingly sequentially formed on the photosensitive drums 32 of the process cartridges PY, PM, PC, and PK, respectively.

After that, the electrostatic latent images are developed with toners in the respective colors and visualized, and by a primary transfer bias applied to the primary transfer roller 39, the toner images with the respective colors that are formed on the photosensitive drums 32 are sequentially transferred to the intermediate transfer belt 36 in a superimposed manner. A toner image is thereby formed on the intermediate transfer belt 36.

Concurrently with the toner image formation operation, the sheets S are fed one by one from the cassette feeding unit 9A or 9B or the manual feeding unit 50. The sheet S fed from the cassette feeding unit 9A or 9B passes through the first pre-registration roller pair 11, and is conveyed to the registration roller pair 13. By the first pre-registration roller pair 11 and the registration roller pair 13, the skew of the sheet S is corrected. Specifically, the leading end of the sheet S to be conveyed is brought into contact with a nip portion of the stopped registration roller pair 13. The first pre-registration roller pair 11 further conveys the sheet S, forms a loop, and performs skew correction. Similarly, the sheet S fed from the manual feeding unit 50 passes through the second pre-registration roller pair 12, and is conveyed to the registration roller pair 13. By the second pre-registration roller pair 12 and the registration roller pair 13, the skew of the sheet S is corrected. In the present exemplary embodiment, a skew correction unit 10 includes the first pre-registration roller pair 11, the second pre-registration roller pair 12, the registration roller pair 13, the first sensor S1, and the second sensor S2. The details of control to be executed when a loop is formed by the skew correction unit 10 will be described below.

The registration roller pair 13 conveys the sheet S to the secondary transfer portion 38 in synchronization with a timing at which the toner image on the intermediate transfer belt 36 is transferred to the sheet S. In the secondary transfer portion 38, by a secondary transfer bias applied to the secondary transfer roller 37, toner images are collectively transferred onto the sheet S.

The sheet S to which the toner images are transferred is conveyed to the fixing unit 201E, and receives heat and pressure at a roller nip portion formed by a pressure roller 220*a* and a heating roller 220*b*, whereby toners of the respective colors are melted and mixed, and fixed to the sheet S as a color image. The sheet S to which the image is fixed is discharged to the discharge space V by the first discharge roller pair 225*a* or the second discharge roller pair 225*b* provided downstream of the fixing unit 201E, and stacked on a discharge tray 223 protruding on the bottom surface of the discharge space V.

On the other hand, when images are to be formed on both sides of the sheet S, the reversing roller pair 222 is once stopped in a state in which the rear end of the sheet S remains at a predetermined distance from the reversing roller pair 222, and then, the reversing roller pair 222 is rotated backward, and the sheet S is caused to pass through the second pre-registration roller pair 12 via the re-conveyance path 224. Then, the sheet S is conveyed again to the registration roller pair 13, skew correction is performed, and an image is formed and fixed on a second surface of the sheet S by the image forming unit 201B.

[Skew Correction Unit]

Figure 3:
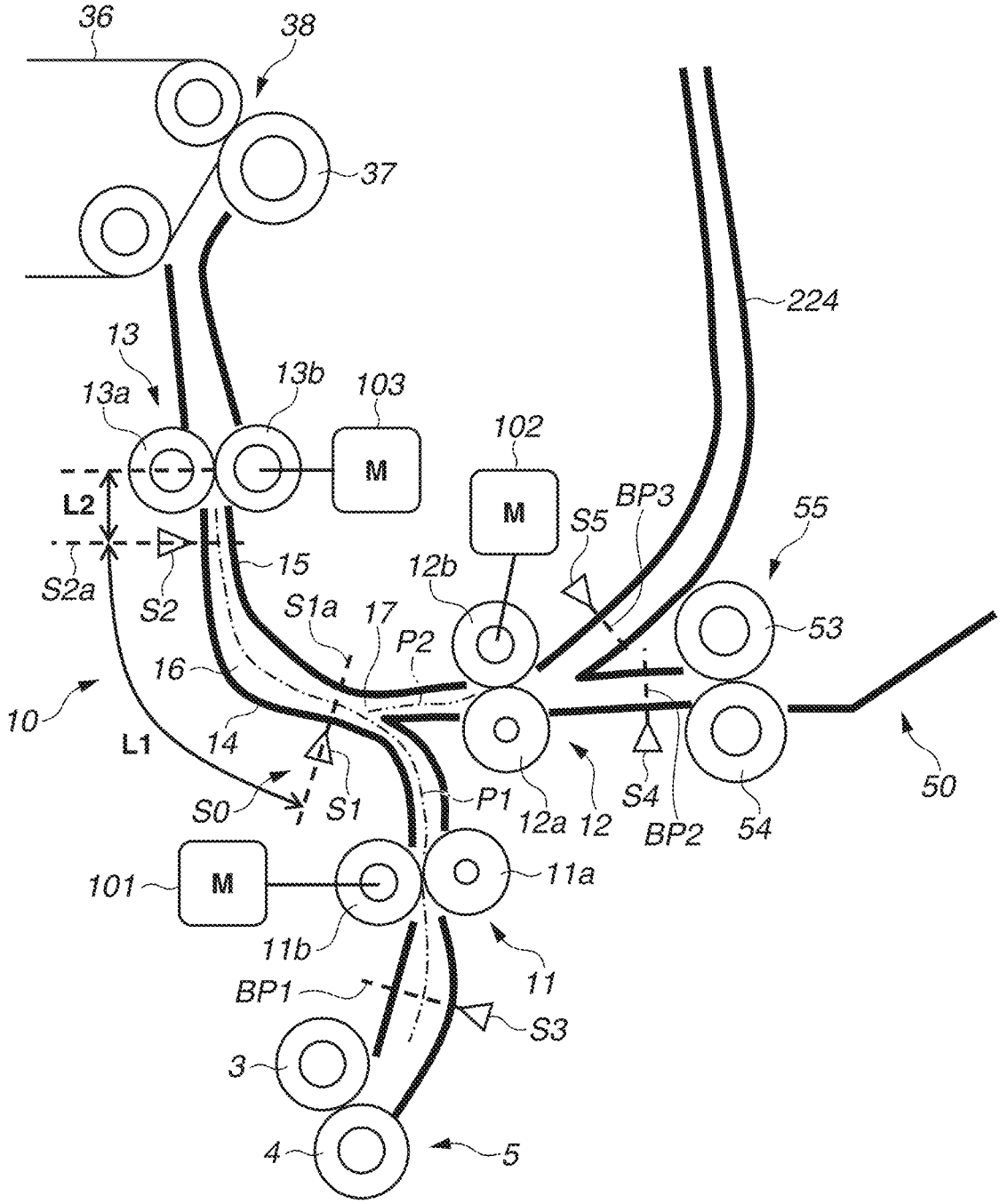
FIG. 3 is a cross-sectional diagram illustrating a skew correction unit according to the exemplary embodiment.

The skew correction unit 10 will be described with reference to FIG. 3. FIG. 3 is a cross-sectional diagram illustrating the skew correction unit 10 viewed from the front side. The first pre-registration roller pair 11 is arranged downstream in the sheet conveyance direction of the feeding units 6A and 6B of the cassette feeding units 9A and 9B. The first pre-registration roller pair 11 includes a driven roller 11*a* including a roller made of polyacetal (POM), and a drive roller 11*b* formed of a rubber roller and arranged to face the driven roller 11*a*. The driven roller 11*a* is brought into pressure contact with the drive roller 11*b* by elastic force of a spring (not illustrated). The drive roller 11*b* is driven by the first pre-registration motor 101. The first pre-registration roller pair 11 is an example of a first conveyance roller pair that conveys the sheet S to the registration roller pair 13.

The registration roller pair 13 is provided downstream of the first pre-registration roller pair 11 in the sheet conveyance direction, and functions as a contact portion that the leading end of the conveyed sheet S contacts in such a manner as to correct the skew of the sheet S. The registration roller pair 13 includes a driven roller 13*a* and a drive roller 13*b*, and the skew of the sheet S is corrected when the sheet S comes into contact with a nip portion formed of the driven roller 13*a* and the drive roller 13*b* in such a manner that the leading end of the sheet S fits with the nip portion. That is, the registration roller pair 13 corrects the skew of the sheet S by coming into contact with the downstream end of the sheet S in the sheet conveyance direction, and then conveys the sheet S while nipping the sheet S therebetween. The registration roller pair 13 includes the driven roller 13*a* including a roller made of polyacetal (POM), and the drive roller 13*b* formed of a rubber roller and arranged to face the driven roller 13*a*. The driven roller 13*a* is brought into pressure contact with the drive roller 13*b* by elastic force of a spring (not illustrated). The drive roller 13*b* is driven by the registration motor 103.

Between the first pre-registration roller pair 11 and the registration roller pair 13, a first guide member 14 that guides the conveyed sheet S, and a second guide member 15 facing the first guide member 14 are arranged. An interval between the first guide member 14 and the second guide member 15 is broadened especially at the central part in the sheet conveyance direction, and a loop formation portion 16 being a space where the sheet S brought into contact with the nip portion of the registration roller pair 13 can form a loop is formed. In the present exemplary embodiment, a passage on which the first pre-registration roller pair 11 and the registration roller pair 13 are arranged and the sheet S is conveyed in the sheet conveyance direction will be referred to as a first conveyance path P1.

On the other hand, the sheet S conveyed from the re-conveyance path 224 or the manual feeding unit 50 is conveyed to the registration roller pair 13 through the second pre-registration roller pair 12. At this time, the conveyed sheet S passes through a merging point 17 that merges with the first conveyance path P1 between the first pre-registration roller pair 11 and the registration roller pair 13. In the present exemplary embodiment, a passage on which the second pre-registration roller pair 12 is arranged and the sheet S is conveyed in the sheet conveyance direction, and which merges with merging point 17 will be referred to as a second conveyance path P2.

The second pre-registration roller pair 12 includes a driven roller 12*a* including a roller made of polyacetal (POM), and a drive roller 12*b* formed of a rubber roller and arranged to face the driven roller 12*a*. The driven roller 12*a* is brought into pressure contact with the drive roller 12*b* by elastic force of a spring (not illustrated). The drive roller 12*b* is driven by the second pre-registration motor 102. The second pre-registration roller pair 12 is an example of a second conveyance roller pair that conveys the sheet S from the merging point 17 to the registration roller pair 13 via the first conveyance path P1.

The first sensor S1 that detects the leading end of the sheet S (i.e., downstream end in the sheet conveyance direction) is arranged near and downstream of the merging point 17 in the sheet conveyance direction. In the present exemplary embodiment, the first sensor S1 detects the leading end of the sheet S at a first detection position Sla positioned between the registration roller pair 13 and the merging point 17 on the first conveyance path P1. The second sensor S2 is arranged downstream of the first sensor S1 in the sheet conveyance direction. The second sensor S2 detects the leading end of the sheet S at a second detection position S2*a* positioned between the first detection position Sla and the registration roller pair 13. A distance on the first conveyance path P1 from the first detection position Sla to the second detection position S2*a* is set to a distance L1. A distance on the first conveyance path P1 from the second detection position S2*a* to the nip portion formed of the registration roller pair 13 is set to a distance L2. The first sensor S1 and the second sensor S2 are used for sheet conveyance control during loop formation.

The first sensor S1 includes, for example, a flag that moves by coming into contact with the leading end of the sheet S, and an optical sensor that detects light beams blocked by the rotation of the flag. The first sensor S1 can be therefore manufactured with relatively low cost. As the second sensor S2, an optical sensor including a light emission unit and a light receiving unit is applied. Accordingly, since the second sensor S2 can perform highly-precise detection, it is possible to execute highly-precise control when using the detection by the second sensor S2 at a feeding timing of the next sheet S, for example.

In the present exemplary embodiment, the first sensor S1 and the second sensor S2 form a detection unit S0. On the first conveyance path P1, a third sensor S3 that detects the presence or absence of the sheet S is arranged upstream of the first pre-registration roller pair 11. The third sensor S3 detects the leading end of the sheet S at a first reference position BP1. A fourth sensor S4 that detects the presence or absence of the sheet S is arranged upstream of the second pre-registration roller pair 12 and downstream of the manual feeding unit 50. The fourth sensor S4 detects the leading end of the sheet S at a second reference position BP2. A fifth sensor S5 that detects the presence or absence of the sheet S is arranged upstream of the second pre-registration roller pair 12 on the re-conveyance path 224. The fifth sensor S5 detects the leading end of the sheet S at a third reference position BP3.

[Skew Correction Operation]

Figure 4A:
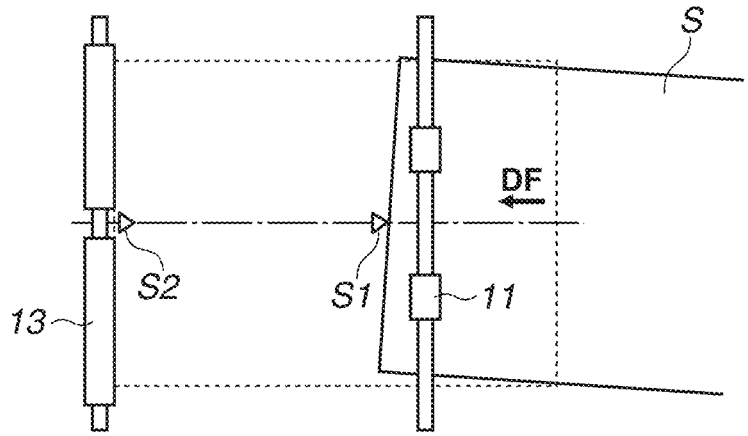
FIGS. 4A to 4C are plan views illustrating the skew correction unit according to the exemplary embodiment.
Figure 4B:
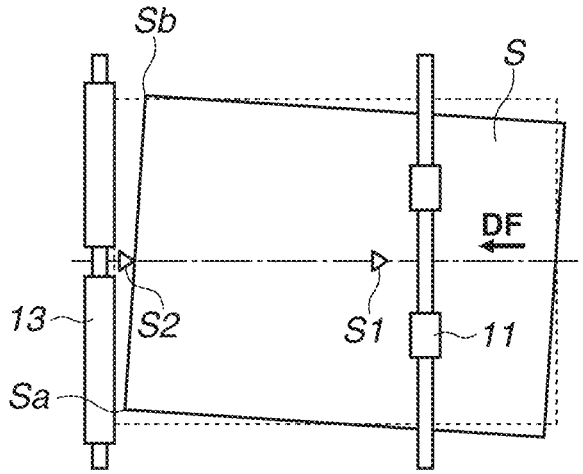
Figure 4C:
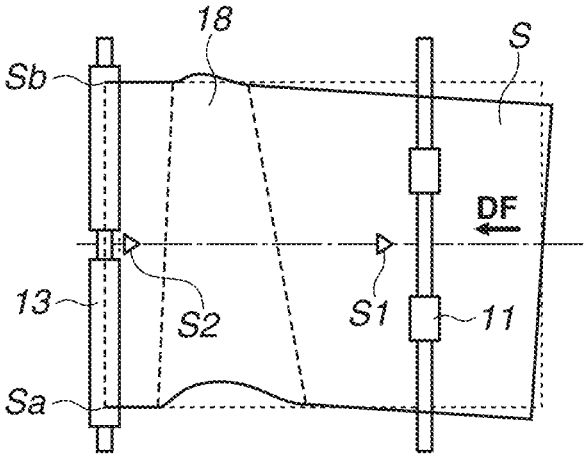

A skew correction operation of the sheet S that is to be performed by the skew correction unit 10 will be described with reference to FIGS. 4A to 4C. As illustrated in FIG. 4A, a skew correction operation to be performed in a case where the sheet S conveyed by the first pre-registration roller pair 11 is skewed clockwise in FIGS. 4A to 4C with respect to a sheet conveyance direction DF will be described. FIG. 4A illustrates a state in which the leading end of the sheet S reaches the first sensor S1 and is detected. When the first pre-registration roller pair 11 is further driven and the sheet S is conveyed in the sheet conveyance direction DF in this state, as illustrated in FIG. 4B, the leading end of the sheet S reaches the second sensor S2 and is detected. After that, when the sheet S is further conveyed, the leading end of the sheet S comes into contact with the nip portion formed of the registration roller pair 13. At this time, the registration roller pair 13 is stopped rotation.

When the first pre-registration roller pair 11 is further driven and the sheet S is conveyed in the sheet conveyance direction DF, a corner portion Sa of the leading end of the skewed sheet S comes into contact with the nip portion formed of the registration roller pair 13 and is stopped, and a loop 18 is gradually formed in the sheet S. When the first pre-registration roller pair 11 is further driven, the leading end of the sheet S swings in such a manner that a corner portion Sb on an opposite side of the corner portion Sa being in contact with the nip portion gets closer to the nip portion. Then, as illustrated in FIG. 4C, a whole region of the leading end of the sheet S in the sheet conveyance direction DF comes into contact with the nip portion formed of the registration roller pair 13. At this time, the loop 18 is formed in the sheet S at a position between the registration roller pair 13 and the first pre-registration roller pair 11. The whole region of the leading end of the sheet S is thereby brought into contact with the nip portion formed of the registration roller pair 13, so that the skew is corrected.

The arrangement orientation of each component of the skew correction unit 10 will be described with reference to FIGS. 1 and 3. As illustrated in FIG. 1, in the present exemplary embodiment, a configuration of a vertical path on which a conveyance path from the feeding units 6A and 6B to the secondary transfer portion 38 is oriented upward is employed. For this reason, as illustrated in FIG. 3, nip lines of the first pre-registration roller pair 11 and the registration roller pair 13 are provided in such a manner as to extend along a vertical direction. With this configuration, because the nip lines of the first pre-registration roller pair 11 and the registration roller pair 13 are provided approximately in parallel, it is possible to reduce a conveyance resistance to be generated during sheet conveyance from the first pre-registration roller pair 11 to the registration roller pair 13.

The first guide member 14 is arranged between the registration roller pair 13 and the merging point 17 on the first conveyance path P1, and provided in such a manner as to intersect with the nip line of the registration roller pair 13. For this reason, the leading end of the sheet S conveyed from the first pre-registration roller pair 11 is guided along the second guide member 15, and then guided by the first guide member 14 in the vicinity of the registration roller pair 13, and comes into contact with the nip portion formed of the registration roller pair 13. After coming into contact with the nip portion of the registration roller pair 13, by being further conveyed by the first pre-registration roller pair 11, the sheet S has come in contact with the first guide member 14. By the sheet S being further conveyed by the first pre-registration roller pair 11, the loop 18 is formed toward the second guide member 15 in the loop formation portion 16.

That is, the sheet S brought into contact with the registration roller pair 13 in a stopped state is positioned along the first guide member 14, and then further conveyed, whereby the loop 18 is formed in a direction away from the first guide member 14.

On the other hand, a nip line of the second pre-registration roller pair 12 is provided in such a manner as to extend along a horizontal direction. That is, the nip line of the second pre-registration roller pair 12 is provided approximately perpendicular to the nip lines of the first pre-registration roller pair 11 and the registration roller pair 13. For this reason, it is possible to reduce a conveyance resistance generated during the conveyance of the sheet S supported on the manual feed tray 51. The leading end of the sheet S conveyed from the second pre-registration roller pair 12 is guided by the first guide member 14, and comes into contact with the nip portion formed of the registration roller pair 13. After the sheet S comes into contact with the nip portion formed of the registration roller pair 13, by being further conveyed by the second pre-registration roller pair 12, the sheet S has come in contact with the first guide member 14. By the sheet S being further conveyed by the second pre-registration roller pair 12, the loop 18 is formed toward the second guide member 15 in the loop formation portion 16.

In the present exemplary embodiment, a case where, because a vertical path configuration is employed, the nip lines of the first pre-registration roller pair 11 and the registration roller pair 13 are provided in such a manner as to extend along the vertical direction has been described, but a configuration is not limited to this case. For example, if the nip lines of the first pre-registration roller pair 11 and the registration roller pair 13 have inclination smaller than 45 degrees with respect to the vertical direction, the vertical path configuration can be employed. A case where the nip line of the second pre-registration roller pair 12 is provided in such a manner as to extend along the horizontal direction has been described, but a configuration is not limited to this case, and for example, a nip line having inclination smaller than 45 degrees with respect to the horizontal direction may be used.

In the present exemplary embodiment, a case where the nip lines of the first pre-registration roller pair 11 and the registration roller pair 13 are provided approximately in parallel has been described, but a configuration is not limited to this case. For example, even though the nip lines of the first pre-registration roller pair 11 and the registration roller pair 13 are not parallel, if the nip line of the first pre-registration roller pair 11 has inclination smaller than 45 degrees with respect to the nip line of the registration roller pair 13, it is possible to reduce a conveyance resistance. In the present exemplary embodiment, a case where the nip line of the second pre-registration roller pair 12 is provided in such a manner as to be approximately perpendicular to the nip lines of the first pre-registration roller pair 11 and the registration roller pair 13 has been described, but a configuration is not limited to this case. For example, if the nip line of the second pre-registration roller pair 12 has inclination exceeding 45 degrees, with respect to the nip line of the registration roller pair 13, it is possible to reduce a conveyance resistance to be generated during the conveyance of the sheet S supported on the manual feed tray 51.

A setting value of an amount of a loop to be formed in the sheet S when the skew of the sheet S is corrected is appropriately set based on sheet information including any one of a size, grammage, and a type of the sheet S.

The control unit 20 can determine a setting value of an optimum loop amount based on at least one piece of information of sheet information designated by the user using the operation unit 23, or sheet information detected by the sheet size detection unit 8A or 8B, or a combination of these. After that, in a case where a toner image is formed on the intermediate transfer belt 36 by the image forming unit 201B, the registration roller pair 13 and the first pre-registration roller pair 11 or the second pre-registration roller pair 12 rotate in synchronization with the image formation, and the sheet S is conveyed in a state where the skew has been corrected.

[Loop Formation Control]

Figure 5A:
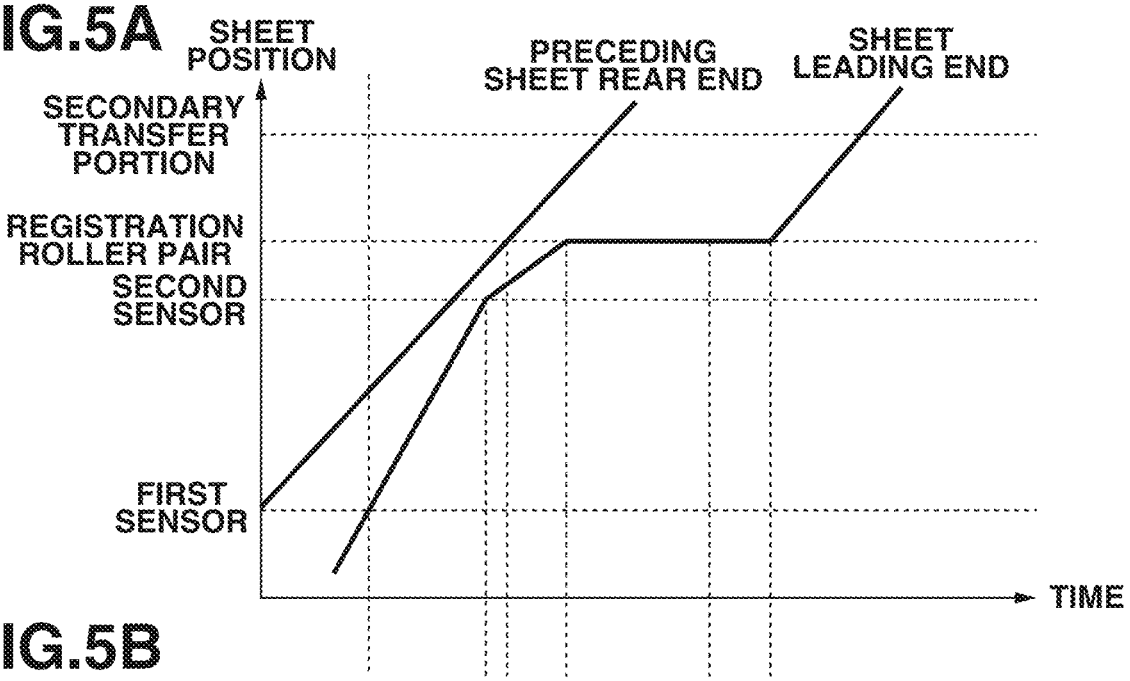
FIGS. 5A to 5C are time charts illustrating control executed when the image forming apparatus according to the exemplary embodiment performs skew correction.
Figure 5B:
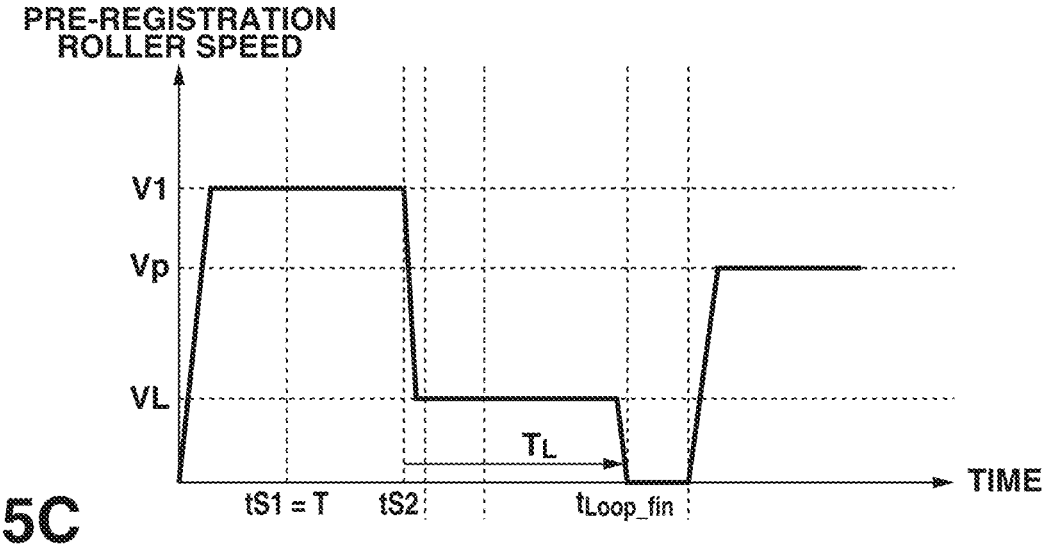
Figure 5C:
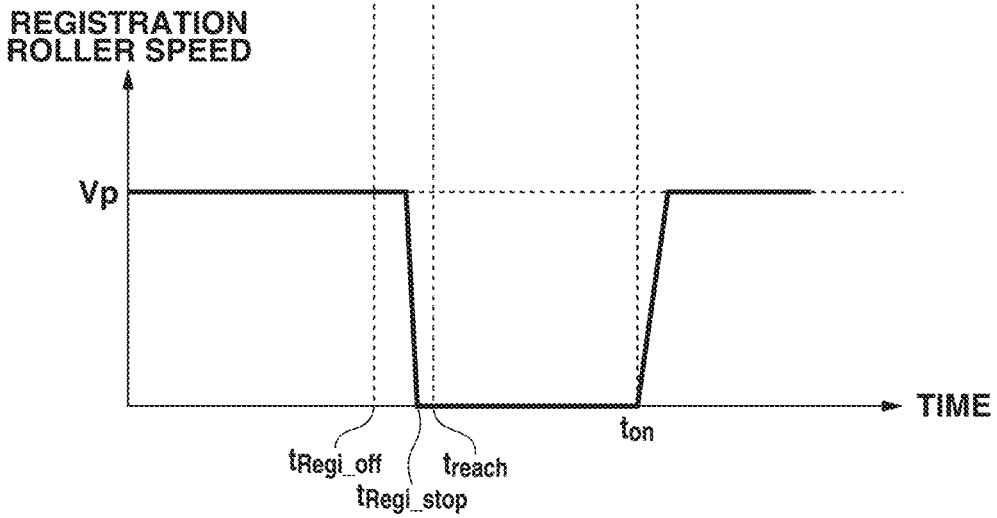

Loop formation control in a skew correction operation of the sheet S that is performed by the skew correction unit 10 will be described with reference to FIGS. 5A to 5C. FIGS. 5A to 5C are timing charts illustrating a basic time-series sheet position, a pre-registration roller speed, and a registration roller speed according to the present exemplary embodiment.

The sheet S conveyed from the feeding unit 6A or 6B is conveyed by the first pre-registration roller pair 11 at a set speed V1, passes through the fourth sensor S4, the first sensor S1, and the second sensor S2, and after that, reaches the registration roller pair 13. After the sheet S reaches the registration roller pair 13 and loop formation is completed, the control unit 20 stops the first pre-registration roller pair 11. At this time, the registration roller pair 13 is stopped at a timing $t_{Regi_stop}$ several tens of milliseconds after a timing $t_{Regi_off}$ at which the rear end of a preceding sheet Q fed earlier than the sheet S passes. The timing $t_{Regi_stop}$ is calculated based on a sheet detection timing of the second sensor S2 and sheet information. Normally, a registration roller reaching timing $t^*_{reach}$ of the sheet S is later than the timing $t_{Regi_stop}$, and the sheet S forms a loop when the sheet S is brought into contact with the stopped registration roller pair 13. The speed of the set speed V1 is not changed at a timing tS1 at which the sheet S is detected by the first sensor S1, but the set speed V1 is changed to a loop formation speed VL lower than the set speed V1 at a timing tS2 at which the sheet S is detected by the second sensor S2. This is to reduce a collision sound to be produced when the sheet S reaches the registration roller pair 13.

An amount of the loop to be formed is managed based on a time TL from the timing tS2 at which the sheet S passes through the second sensor S2 to the time when the first pre-registration roller pair 11 is stopped. The time TL is represented by the following formula. A setting amount Lt of a loop to be formed in the sheet S between the registration roller pair 13 and the first pre-registration roller pair 11 is determined based on the above-described sheet information.

$$TL=(X2+Lt)/VL$$

A timing at which loop formation is completed and after the lapse of the time TL from the timing tS2 is denoted by $T_{Loop_fin}$. After the loop formation is completed, sheet conveyance from the registration roller pair 13 toward the secondary transfer portion 38 is started again at a registration ON timing $t_{on}$. The registration ON timing $t_{on}$ is determined by performing back calculation in such a manner that the sheet S is in time for a timing at which the leading end of an image reaches the secondary transfer portion 38.

As described above, an amount of a loop to be formed is determined based on a timing of passage through the second sensor S2 arranged near the registration roller pair 13. For this reason, because a conveyance distance up to the registration roller pair 13 after the detection of the second sensor S2 is short, it is possible to reduce a conveyance distance variation attributed to component tolerance or an assembly error up to a contact portion after the detection, and a variation in loop formation amount that is attributed to a variation in sheet conveyance speed.

[Speed Change Control of Pre-Registration Roller Pair]

Speed change control of the first pre-registration roller pair 11 and the second pre-registration roller pair 12 will be described. The above-described passage timing tS1 of the first sensor S1 varies. The causes of the variation include a position variation of the sheet S among the feeding units 6A, 6B, and 56, and a variation in conveyance speed between the pre-registration roller pairs 11 and 12. Furthermore, the passage timing tS1 varies depending on the thickness, grammage, or surface texture of the sheet S, changes in a diameter and friction coefficient attributed to abrasion wear of the pre-registration roller pairs 11 and 12 that is caused by continuous sheet passage, the pressure of the pre-registration roller pairs 11 and 12, resistance generated by a conveyance guide, and driving properties of motors.

For example, in a case where a sheet conveyance speed is faster than an expected speed, after a preceding sheet is conveyed, a succeeding sheet reaches the registration roller pair 13 before the registration roller pair 13 completely stops, and before skew correction of the succeeding sheet is started, the leading end of the sheet might pass through the nip portion of the registration roller pair 13. On the other hand, in a case where a sheet conveyance speed is slower than an expected speed, the leading end reaches the registration roller pair 13 belatedly, and a loop with a predetermined loop amount might fail to be formed. Consequently, the leading end position of the sheet might be conveyed to the secondary transfer portion 38 in a skewed state, and an image position failure might occur as an image is obliquely formed with respect to the sheet. Especially in a case where the productivity (the number of printed sheets per unit time) of the image forming apparatus 1 is high, a sheet-to-sheet conveyance interval and a sheet standby time at the registration roller pair 13 are shortened in many cases, and such issues easily occur.

Figure 6A:
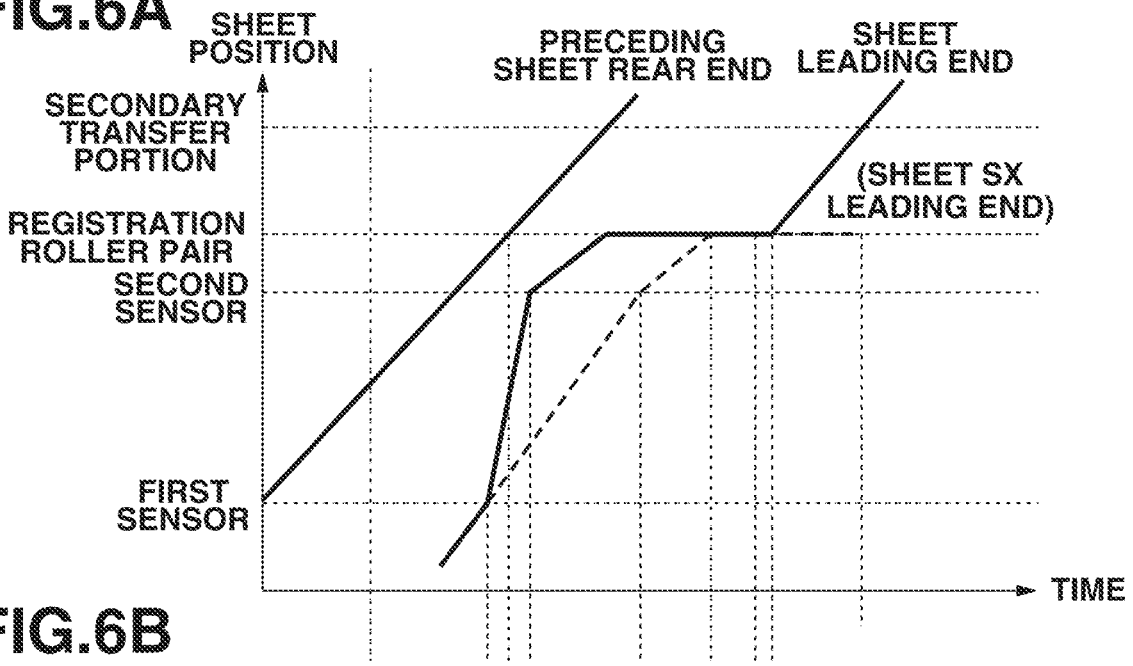
FIGS. 6A to 6C are time charts illustrating control executed when the image forming apparatus according to the exemplary embodiment performs skew correction.
Figure 6B:
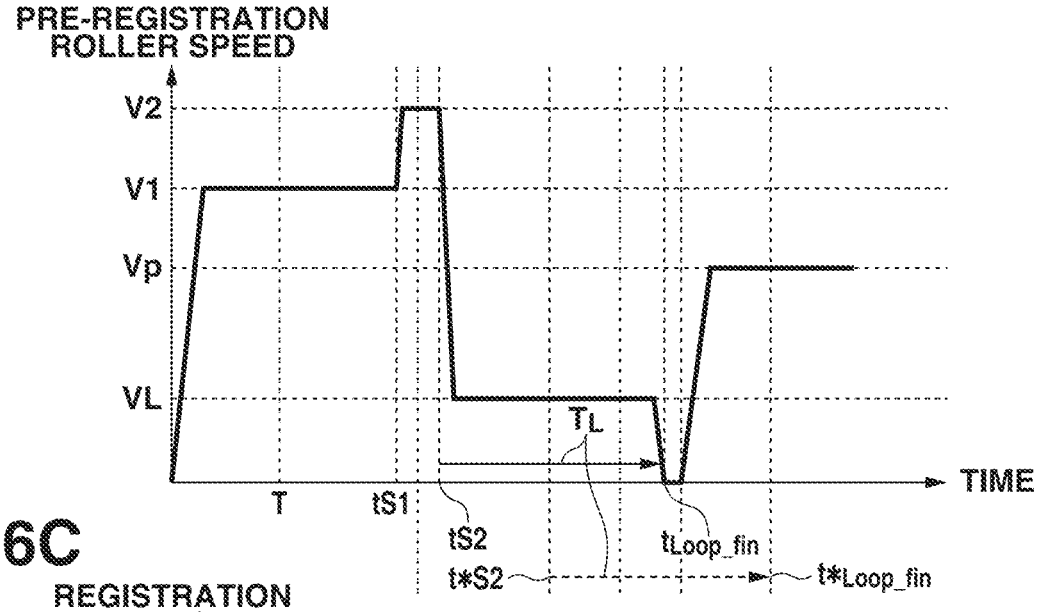
Figure 6C:
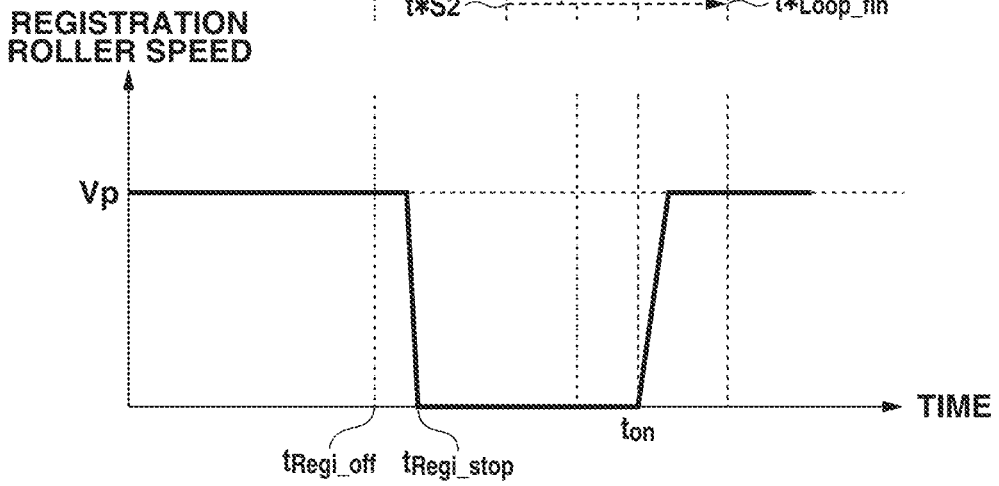

FIGS. 6A and 6C are timing charts illustrating a sheet position, a pre-registration roller speed, and a registration roller speed in a case where the passage timing tS1 is later than a standard timing T serving as a benchmark, by a predetermined time or more. The standard timing T is assumed to be a timing of passage through the first sensor S1 in a case where neither delay nor early arrival of the sheet S occurs. In the present exemplary embodiment, a timing assumed as the timing of passage through the first sensor S1 in a case where neither delay nor early arrival of the sheet S has occurred since the leading end of the sheet S has passed through any of the third sensor S3, the fourth sensor S4, and the fifth sensor S5 is set as the standard timing T.

In FIG. 6A, a dotted line indicates a movement of a leading end of a sheet SX in a case where speed change control of a pre-registration roller is not executed at the first sensor S1, and a solid line indicates an actual movement of the sheet S in a case where speed change control is executed. In a case where delay occurs, a reaching time t*S2 at which the sheet SX reaches the second sensor S2 gets delayed, and a loop formation completion time $t^*_{Loop_fin}$ consequently becomes later than the registration ON timing $t_{on}$, and a loop with a desired loop amount cannot be formed. In contrast to this case, by changing the speed from the set speed V1 to the set speed V2 higher than the set speed V1 at the timing tS1 of passage through the first sensor S1, the delay of the timing tS2 can be reduced, and it becomes possible to complete loop formation by the registration ON timing $t_{on}$.

Figure 7A:
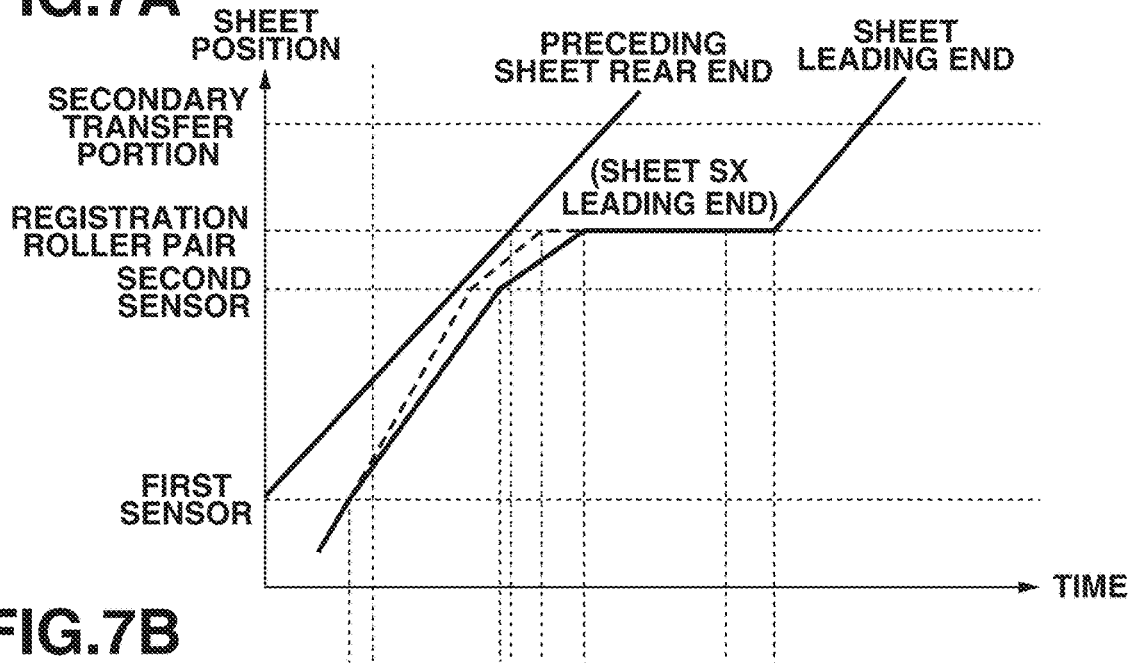
FIGS. 7A to 7C are time charts illustrating control executed when the image forming apparatus according to the exemplary embodiment performs skew correction.
Figure 7B:
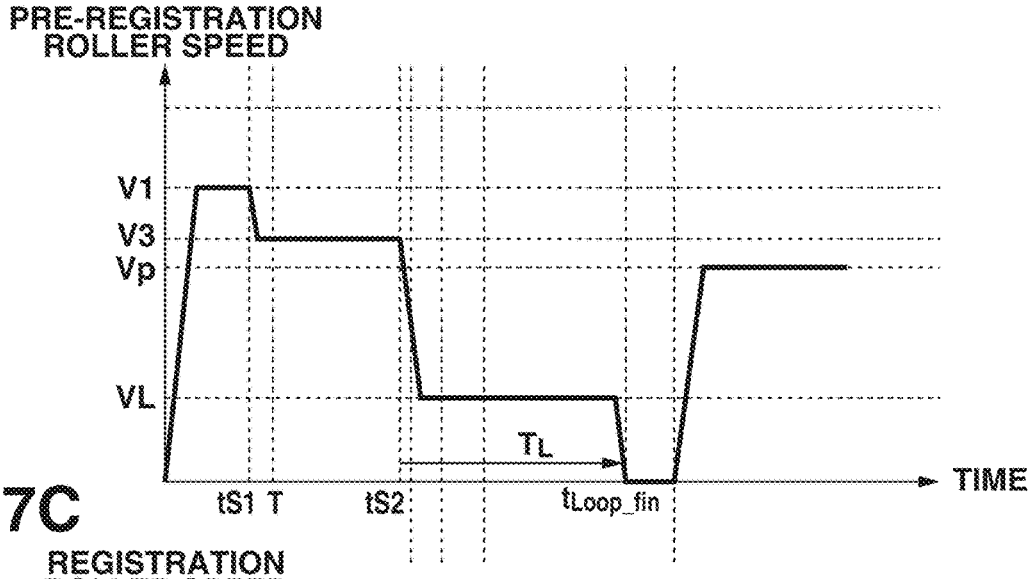
Figure 7C:
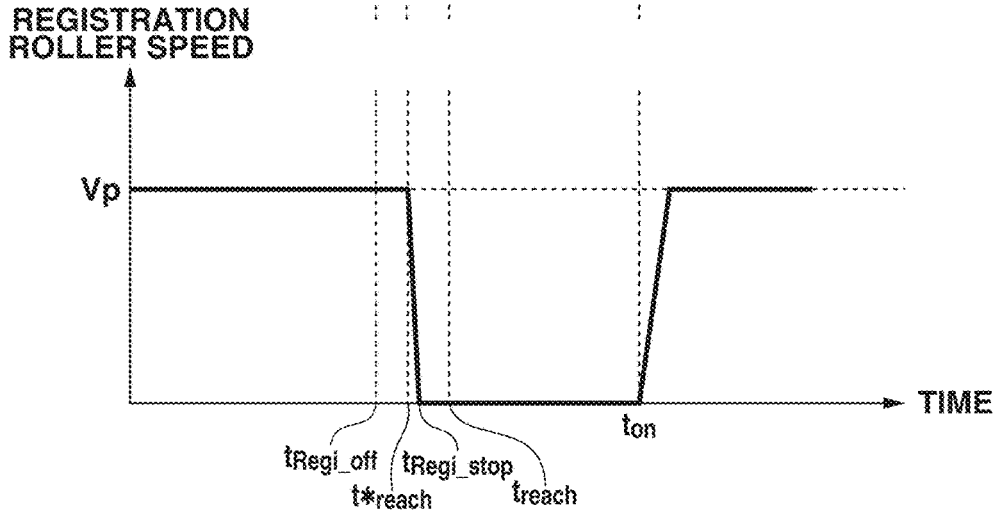

FIGS. 7A to 7C are timing charts illustrating a sheet position, a pre-registration roller speed, and a registration roller speed in a case where the passage timing tS1 is earlier than the standard timing T by a predetermined time or more. At this time, as indicated by a dotted line in FIG. 7A, a reaching time $t^*_{reach}$ at which the sheet SX reaches the registration roller pair 13 gets earlier, and the sheet SX reaches the registration roller pair 13 earlier than the timing $t_{Regi_stop}$ at which the registration roller pair 13 is stopped. Consequently, loop formation is started after the leading end of the sheet passes through the registration roller pair 13, and it becomes impossible to adjust the leading end position and correct the skew of the sheet. In contrast to this case, by changing the speed from the set speed V1 to a set speed V3 lower than the set speed V1 at the timing tS1 of passage through the first sensor S1, it is possible to prevent the sheet SX from reaching the registration roller pair 13 earlier than the reach time $t^*_{reach}$. Then, by the sheet S reaching the registration roller pair 13 after the registration roller pair 13 stops, it becomes possible to appropriately perform loop formation.

The first reference position BP1 where the third sensor S3 is provided is positioned upstream of the first detection position Sla on the first conveyance path P1. Based on a detection result of the third sensor S3, the control unit 20 determines whether the sheet S has passed through the first reference position BP1. A time from when the leading end of a first sheet S conveyed by the first pre-registration roller pair 11 on the first conveyance path P1 passes through the first reference position BP1 until the first sheet S is detected by the detection unit S0 is defined as a first detection time. The first detection time is a time from when the leading end of the first sheet S passes through the first reference position BP1 until the first sheet S is detected by the first sensor S1. At this time, by adjusting the rotational speed of the first pre-registration roller pair 11 in a case where the first detection time is a first time, the control unit 20 sets the conveyance speed of the first sheet S to a first speed (refer to FIG. 5A). In contrast to this case, by adjusting the rotational speed of the first pre-registration roller pair 11 in a case where the first detection time of a second sheet S is a second time longer than the first time, the control unit 20 changes the conveyance speed of the second sheet S to a second speed faster than the first speed (refer to FIG. 6A).

In the present exemplary embodiment, conveyance control during loop formation and speed change control of the first pre-registration roller pair 11 have been described using an example case where the sheet S is fed from the feeding unit 6A or 6B, but a configuration is not limited to this example case. For example, similar conveyance control can be applied, using the second pre-registration roller pair 12, also to the sheet S conveyed from the duplex reversing unit 201F or the manual feeding unit 50. Nevertheless, parameters such as the set speed V1, the reference times t1 and t2, and the changed set speeds V1 and V2 in speed change control by each pre-registration roller pair have different values depending on an upstream conveyance path. This is because an expected variation in conveyance timing of the sheet S varies depending on the upstream conveyance path.

For example, the second reference position BP2 where the fourth sensor S4 is provided is positioned upstream of the first detection position S1*a*. Based on a detection result of the fourth sensor S4, the control unit 20 determines whether the sheet S has passed through the second reference position BP2. A time from when the leading end of a third sheet S conveyed by the second pre-registration roller pair 12 on the second conveyance path P2 passes through the second reference position BP2 until the third sheet S is detected by the detection unit S0 is defined as a second detection time. The second detection time is a time from when the leading end of the third sheet S passes through the second reference position BP2 until the third sheet S is detected by the first sensor S1. At this time, by adjusting the rotational speed of the second pre-registration roller pair 12 in a case where the second detection time is a third time, the control unit 20 sets the conveyance speed of the third sheet S to a third speed (refer to FIG. 5A). In contrast to this case, by adjusting the rotational speed of the second pre-registration roller pair 12 in a case where the second detection time of a fourth sheet S is a fourth time longer than the third time, the control unit 20 changes the conveyance speed of the fourth sheet S to a fourth speed faster than the third speed (refer to FIG. 6A).

The third reference position BP3 where the fifth sensor S5 is provided is positioned upstream of the first detection position Sla. Based on a detection result of the fifth sensor S5, the control unit 20 determines whether the sheet S has passed through the third reference position BP3. A time from when the leading end of a fifth sheet S conveyed by the second pre-registration roller pair 12 on the second conveyance path P2 passes through the third reference position BP3 until the fifth sheet S is detected by the detection unit S0 is defined as a third detection time. The third detection time is a time from when the leading end of the fifth sheet S passes through the third reference position BP3 until the fifth sheet S is detected by the first sensor S1. At this time, by adjusting the rotational speed of the second pre-registration roller pair 12 in a case where the third detection time is a fifth time, the control unit 20 sets the conveyance speed of the fifth sheet S to a fifth speed (refer to FIG. 5A). In contrast to this case, by adjusting the rotational speed of the second pre-registration roller pair 12 in a case where the third detection time of a sixth sheet S is a sixth time longer than the fifth time, the control unit 20 changes the conveyance speed of the sixth sheet S to a sixth speed faster than the fifth speed (refer to FIG. 6A).

[Operation Procedure]

Figure 8:
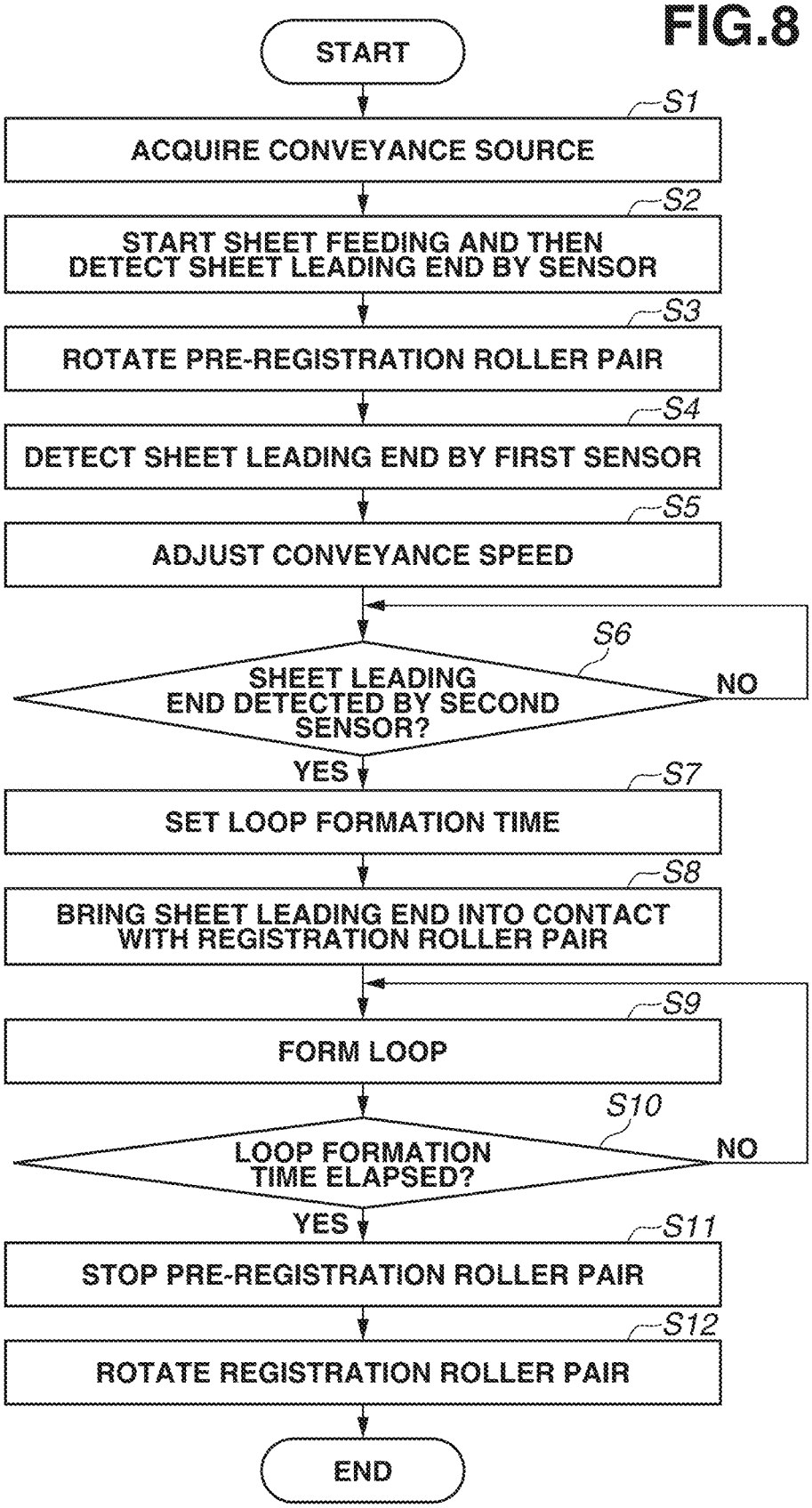
FIG. 8 is a flowchart illustrating a procedure of skew correction to be performed by the image forming apparatus according to the exemplary embodiment.

An operation procedure of the skew correction unit 10 will be described in accordance with a flowchart illustrated in FIG. 8. In step S1, after the start of an image formation job, the control unit 20 acquires a conveyance source from which the sheet S is conveyed, from among the cassette feeding units 9A and 9B, the re-conveyance path 224, and the manual feeding unit 50. In step S2, after the conveyance source is acquired, the control unit 20 starts feeding the sheet S, and any of the third sensors S3 to fifth sensor S5 detects the leading end of the sheet S.

In step S3, the control unit 20 rotates the first pre-registration roller pair 11 or the second pre-registration roller pair 12 depending on the conveyance source. After the leading end of the sheet S is detected by the first sensor S1 in step S4, in step S5, the control unit 20 adjusts a conveyance speed of the sheet S at the time point. The adjustment method has been described above. Furthermore, in step S6, the control unit 20 determines whether the leading end of the sheet S has been detected by the second sensor S2. In a case where the control unit 20 determines that the leading end of the sheet S has not been detected by the second sensor S2 (NO in step S6), detection is continued. In a case where the control unit 20 determines that the leading end of the sheet S has been detected by the second sensor S2 (YES in step S6), the processing proceeds to step S7. In step S7, a loop formation time T2 is set based on a detection time to obtained from the actual speed. That is, the control unit 20 calculates a time from when the leading end of the sheet S is detected by the first sensor S1 until the leading end of the sheet S is detected by the second sensor S2. Then, based on the calculated time, the control unit 20 adjust a loop amount of the sheet S by adjusting a conveyance amount of the sheet S to be conveyed from the first pre-registration roller pair 11 or the second pre-registration roller pair 12 toward the registration roller pair 13 that is stopped.

In step S8, the control unit 20 continues the rotation of the first pre-registration roller pair 11 or the second pre-registration roller pair 12, and brings the leading end of the sheet S into contact with the nip portion of the stopped registration roller pair 13.

In step S9, by further continuing the rotation of the first pre-registration roller pair 11 or the second pre-registration roller pair 12, the control unit 20 forms the loop 18 of the sheet S. In step S10, the control unit 20 determines whether the loop formation time T2 has elapsed. In a case where the control unit 20 determines that the loop formation time T2 has not elapsed (NO in step S10), the processing returns to step S9. In step S9, the control unit 20 continues the formation of the loop 18 of the sheet S. In a case where the control unit 20 determines that the loop formation time T2 has elapsed (YES in step S10), the processing proceeds to step S11. In step S11, the control unit 20 stops a rotating pre-registration roller pair. In step S12, the control unit 20 rotates the registration roller pair 13 in synchronization with the timing of image formation.

As described above, according to the image forming apparatus 1 according to the present exemplary embodiment, a sheet speed is adjusted using the registration roller pair 13 and the detection unit S0 arranged between the pre-registration roller pairs 11 and 12.

For this reason, by optimizing a timing at which a sheet reaches the registration roller pair 13, it is possible to highly precisely execute skew correction of the sheet. That is, even in a case where a conveyance timing of the sheet S in the first sensor S1 deviates from an expected timing due to a variation in position among the feeding units 6A, 6B, and 56 of the sheet S, and a variation in conveyance speed, it is possible to reduce a variation in a subsequent conveyance timing. With this configuration, it becomes possible to stably perform loop formation with a predetermined amount in a state in which the leading end of the sheet S is in contact with the registration roller pair 13, and it is possible to improve image position precision such as image skew and a leading end position. Especially in a case where the productivity (the number of printed sheets per unit time) of the image forming apparatus 1 is desired to be made high, it is effective to shorten a sheet-to-sheet conveyance interval and a sheet standby time at the registration roller pair 13. According to the present exemplary embodiment, because an interval from the registration stop timing $t_{Regi_stop}$ to the re-conveyance start $t_{on}$ becomes shorter, it is possible to reduce a variation in conveyance timing.

According to the present exemplary embodiment, the detection unit S0 is arranged between the registration roller pair 13 and the merging point 17. For this reason, by performing speed change control of the sheets S conveyed from a plurality of different upstream conveyance paths, at a detection timing of one sensor, it is possible to improve image printing precision. With this configuration, it is possible to reduce the number of arranged sensors as compared with a case where sensors are respectively arranged on a plurality of upstream conveyance paths, and it is possible to obtain a cost reduction effect.

According to the present exemplary embodiment, a loop amount of the sheet S is adjusted based on a detection time obtained from an actual speed. For this reason, even in a case where the speed of the sheet S changes depending on the rigidity or surface texture of the sheet S, or a sheet conveyance resistance, it is possible to optimize a loop amount of the sheet S during skew correction. With this configuration, it is possible to prevent deterioration in image formation accuracy that is attributed to an insufficient loop amount and insufficient skew correction, and the generation of sound noise and sheet crease, and the occurrence of torque increase of a pre-registration motor that are attributed to an excessive loop amount.

In the above-described first exemplary embodiment, the control unit 20 determines the rotational speed of the first pre-registration roller pair 11 based on a time from when the leading end of the sheet is detected by the third sensor S3 until the sheet is detected by the first sensor S1. In a second exemplary embodiment, a control unit 20 determines the rotational speed of the first pre-registration roller pair 11 based on a time from a timing at which a feeding unit feeds a sheet until the leading end of the sheet is detected by the first sensor S1.

The components assigned the same reference numerals as those in the first exemplary embodiment have basically the same configurations and functions as those described in the first exemplary embodiment, unless otherwise specifically described, and parts different from the first exemplary embodiment will be mainly described.

In the above-described first exemplary embodiment, the fourth sensor S4 is arranged downstream of the manual feeding unit 50, and the fifth sensor S5 is arranged on the re-conveyance path 224. On the other hand, in the second exemplary embodiment, a sheet conveyance device does not include the fourth sensor S4 or the fifth sensor S5.

In the second exemplary embodiment, a time from when a feeding start signal is output until a leading end of a sheet reaches the first sensor S1 without delay or early arrival will be referred to as a target time. In other words, a standard timing T serving as a benchmark is a timing later than a feeding instruction timing corresponding to each sheet by a predefined target time.

The target time from a feeding instruction timing until a leading end of a sheet reaches the first sensor S1 in a case where the sheet is conveyed from the first pre-registration roller pair 11 toward the registration roller pair 13 will be referred to as a first target time. In a case where a time from a feeding instruction timing of the sheet stored in the feeding cassette 7A or 7B until the leading end of the sheet is detected by the first sensor S1 is the same as the first target time, the control unit 20 sets the conveyance speed of the first pre-registration roller pair 11 to a first speed (refer to FIGS. 5A to 5C). In contrast to this case, in a case where a time from a sheet feeding instruction timing until the leading end of the sheet is detected by the first sensor S1 is longer than the first target time, the control unit 20 sets the conveyance speed of the first pre-registration roller pair 11 to a 21st speed larger than the first speed (refer to FIGS. 6A to 6C). In contrast to this case, in a case where a time from a sheet feeding instruction timing until the leading end of the sheet is detected by the first sensor S1 is shorter than the first target time, the control unit 20 sets the conveyance speed of the first pre-registration roller pair 11 to a 22nd speed smaller than the first speed (refer to FIGS. 7A to 7C).

That is, in a case where a time from a timing at which a feeding unit feeds a sheet until the leading end of the sheet is detected by the first sensor S1 is the first time, the sheet is conveyed toward the second sensor S2 in a state in which the conveyance speed of the first pre-registration roller pair 11 is the first speed. In a case where a time from a timing at which a feeding unit feeds a sheet until the leading end of the sheet is detected by the first sensor S1 is a 21st time longer than the first time, the sheet is conveyed toward the second sensor S2 in a state in which the conveyance speed of the first pre-registration roller pair 11 is the 21st speed larger than the first speed.

In other words, in a case where a time from a sheet feeding instruction timing until the leading end of the sheet is detected by the first sensor S1 is the 21st time, the control unit 20 increases the conveyance speed of the first pre-registration roller pair 11 (refer to FIGS. 6A to 6C). In a case where a time from a sheet feeding instruction timing to when the leading end of the sheet is detected by the first sensor S1 is the 22nd time shorter than the 21st time, the control unit 20 decreases the conveyance speed of the first pre-registration roller pair 11 (refer to FIGS. 7A to 7C).

In the sheet conveyance direction, the first sensor S1 and the second sensor S2 are arranged between the first pre-registration roller pair 11 and the registration roller pair 13. Based on the time from a timing at which the control unit 20 issues a sheet feeding instruction until the leading end of the sheet is detected by the first sensor S1, the sheet conveyance speed of the first pre-registration roller pair 11 is adjusted in such a manner that the leading end of the sheet reaches the second sensor S2 and the registration roller pair 13 on time. Furthermore, the control unit 20 controls loop formation based on a timing of passage through the second sensor S2 arranged near the registration roller pair 13. With this configuration, it is possible to optimize a timing at which the sheet reaches the registration roller pair 13 and reduce a variation in loop formation amount.

When an image is to be formed on a second surface of a sheet, a target time from a feeding instruction timing until a leading end of a sheet reaches the first sensor S1 in a case where the sheet is conveyed from the second pre-registration roller pair 12 toward the registration roller pair 13 will be referred to as a second target time. Specifically, the second target time is a time from a sheet feeding instruction timing until an image is formed on a first surface of the sheet, the sheet on which the image is formed on the first surface is conveyed to the re-conveyance path 224, and furthermore, the leading end of the sheet reaches the first sensor S1 in a case where neither delay nor early arrival occurs.

In a case where a time from a sheet feeding instruction timing until the leading end of the sheet is detected by the first sensor S1 is the same as the second target time, the control unit 20 sets the conveyance speed of the second pre-registration roller pair 12 to a third speed (refer to FIGS. 5A to 5C). In contrast to this case, in a case where a time from a sheet feeding instruction timing until the leading end of the sheet is detected by the first sensor S1 is longer than the second target time, the control unit 20 sets the conveyance speed of the first pre-registration roller pair 11 to a 41st speed larger than the third speed (refer to FIGS. 6A to 6C). In contrast to this case, in a case where a time from a sheet feeding instruction timing until the leading end of the sheet is detected by the first sensor S1 is shorter than the second target time, the control unit 20 sets the conveyance speed of the first pre-registration roller pair 11 to a 42nd speed smaller than the third speed (refer to FIGS. 7A to 7C).

That is, when an image is to be formed on a first surface, based on the time from a sheet feeding instruction timing until the leading end of the sheet is detected by the first sensor S1, the control unit 20 determines the conveyance speed of the first pre-registration roller pair 11, and conveys the sheet toward the second sensor S2. When the skew of the sheet is corrected to form an image on a second surface of the sheet on which an image is formed on the first surface, based on the time from a sheet feeding instruction timing until the leading end of the sheet on which an image is formed on the first surface is detected by the first sensor S1, the control unit 20 determines the conveyance speed of the second pre-registration roller pair 12. In the present exemplary embodiment, the first sensor S1 and the second sensor S2 are arranged between the registration roller pair 13 and the merging point 17. With this configuration, it is possible to improve image printing precision without arranging a sensor on the re-conveyance path 224.

A target time until the leading end of a sheet reaches the first sensor S1 in a case where the sheet is conveyed from the manual feed tray 51 toward the registration roller pair 13 will be referred to as a third target time. The third target time is a time from a feeding instruction timing of a sheet stored in the manual feed tray 51 until the leading end of the sheet reaches the first sensor S1 in a case where neither delay nor early arrival occurs.

In a case where a time from a sheet feeding instruction timing until the leading end of the sheet is detected by the first sensor S1 is the same as the third target time, the control unit 20 sets the conveyance speed of the second pre-registration roller pair 12 to a fifth speed (refer to FIGS. 5A to 5C). In contrast to this case, in a case where a time from a sheet feeding instruction timing until the leading end of the sheet is detected by the first sensor S1 is longer than the third target time, the control unit 20 sets the conveyance speed of the first pre-registration roller pair 11 to a 61st speed larger than the fifth speed (refer to FIGS. 6A to 6C). In contrast to this case, in a case where a time from a sheet feeding instruction timing until the leading end of the sheet is detected by the first sensor S1 is shorter than the third target time, the control unit 20 sets the conveyance speed of the first pre-registration roller pair 11 to a 62nd speed smaller than the fifth speed (refer to FIGS. 7A to 7C). With this configuration, it is possible to improve image printing precision without arranging a sensor between the separation roller pair 55 and the second pre-registration roller pair 12.

In the above-described exemplary embodiments, the image forming apparatus 1 employs a configuration of a vertical path on which a conveyance path from the feeding units 6A and 6B to the secondary transfer portion 38 is oriented upward, but a configuration is not limited to this example, and a configuration of a horizontal path may be employed.

In the above-described exemplary embodiments, the image forming apparatus 1 being a color laser printer has been described as an example, but the image forming apparatus 1 is not limited to this example. For example, the present disclosure may be applied to an image forming apparatus being a monochrome laser printer.

According to the present disclosure, it is possible to highly precisely correct skew of sheets.

While the present disclosure has been described with reference to various exemplary embodiments, it is to be understood that the present disclosure is not limited to the disclosed embodiments. The scope of the following claims is to be accorded the broadest interpretation so as to encompass all such modifications and equivalent structures and functions.

This application claims the benefit of priority from Japanese Patent Applications No. 2024-115134, filed Jul. 18, 2024, and No. 2025-077310, filed May 7, 2025, which are hereby incorporated by reference herein in their entirety.

What is claimed is:

1. A sheet conveyance device comprising:

a feeding unit configured to feed a sheet from a sheet storage unit configured to store a sheet;

a first conveyance path on which the sheet fed by the feeding unit is conveyed in a sheet conveyance direction;

a registration roller pair that is arranged on the first conveyance path, and is configured to come into contact with a leading end of the sheet in the sheet conveyance direction and correct skew of the sheet, and then convey the sheet while nipping the sheet therebetween;

a first conveyance roller pair that is arranged on the first conveyance path, and is configured to convey the sheet to the registration roller pair;

a first sensor that is arranged between the first conveyance roller pair and the registration roller pair on the first conveyance path, and is configured to detect the leading end of the sheet;

a second sensor that is arranged between the registration roller pair and the first sensor, and is configured to detect the leading end of the sheet; and a control unit configured to control conveyance of the sheet, wherein, based on a detection result of the second sensor, the control unit controls the first conveyance roller pair to correct skew of the sheet, and wherein, when a sheet is conveyed from the first conveyance roller pair toward the registration roller pair, in a case where a time from a timing at which the feeding unit feeds the sheet until the leading end of the sheet is detected by the first sensor is a first time, the control unit controls the conveyance of the sheet so that the sheet is conveyed toward the second sensor in a state in which a conveyance speed of the first conveyance roller pair is a first speed, and in a case where a time from a timing at which the feeding unit feeds the sheet until the leading end of the sheet is detected by the first sensor is a second time longer than the first time, the control unit controls the conveyance of the sheet so that the sheet is conveyed toward the second sensor in a state in which a conveyance speed of the first conveyance roller pair is a second speed larger than the first speed.

2. The sheet conveyance device according to claim 1, wherein the first sensor includes a flag configured to move by coming into contact with the sheet, and the second sensor is an optical sensor including a light emission unit and a light receiving unit.

3. The sheet conveyance device according to claim 1, wherein the control unit controls the conveyance of the sheet so that the sheet is conveyed in a state in which the conveyance speed of the first conveyance roller pair is a third speed until the leading end of the sheet reaches the first sensor, the first speed is smaller than the third speed, and the second speed is larger than the third speed.

4. The sheet conveyance device according to claim 1, wherein, in the sheet conveyance direction, the registration roller pair is a conveyance roller pair arranged subsequent to the first conveyance roller pair.

5. The sheet conveyance device according to claim 1, further comprising:

a second conveyance path merging with a merging point that is provided between the registration roller pair and the first conveyance roller pair on the first conveyance path; and a second conveyance roller pair that is arranged on the second conveyance path, and is configured to convey the sheet to the registration roller pair from the merging point via the first conveyance path, wherein the first sensor is arranged between the merging point and the registration roller pair in the sheet conveyance direction.

6. The sheet conveyance device according to claim 5, wherein, when the sheet is conveyed from the second conveyance roller pair toward the registration roller pair, in a case where a time from a timing at which the feeding unit feeds the sheet until the leading end of the sheet is detected by the first sensor is a third time, the control unit controls the conveyance of the sheet so that the sheet is conveyed toward the second sensor in a state in which the conveyance speed of the second conveyance roller pair is a third speed, and in a case where a time from a timing at which the feeding unit feeds the sheet, until the leading end of the sheet is detected by the first sensor is a fourth time longer than the third time, the control unit controls the conveyance of the sheet so that the sheet is conveyed toward the second sensor in a state in which the conveyance speed of the second conveyance roller pair is a fourth speed larger than the third speed.

7. The sheet conveyance device according to claim 5, wherein the sheet storage unit is accommodated in an apparatus main body, and is a first sheet storage unit storing sheets, wherein the feeding unit is a first feeding unit configured to feed a sheet stored in the sheet storage unit, to the first conveyance roller pair, and wherein the sheet conveyance device further includes:

a manual feed tray that is freely opened and closed with respect to the apparatus main body, and is configured to support sheets stacked on a top surface in a state in which the manual feed tray is opened; and a second feeding unit configured to feed the sheets supported on the manual feed tray to the second conveyance roller pair.

8. The sheet conveyance device according to claim 5, wherein, based on a time from when the leading end of the sheet is detected by the first sensor until the leading end of the sheet is detected by the second sensor, the control unit adjusts a loop amount of the sheet by adjusting a conveyance amount by which the sheet is conveyed by the first conveyance roller pair or the second conveyance roller pair toward the registration roller pair in a state where the registration roller pair is stopped.

9. The sheet conveyance device according to claim 1, wherein a conveyance speed of the first conveyance roller pair that is set when skew of the sheet is corrected after the leading end of the sheet passes through the second sensor is smaller than the first speed and the second speed.

10. An image forming apparatus comprising:

the sheet conveyance device according to claim 1; and an image forming unit configured to form an image on a sheet.

11. The image forming apparatus according to claim 10, further comprising a re-conveyance unit configured to reverse a side of a sheet on which an image is formed by the image forming unit, and convey the sheet to the first conveyance path.

* * * * *